US005700181A

United States Patent [19]

Hashish et al.

[11] Patent Number: 5,700,181

[45] Date of Patent: Dec. 23, 1997

[54] ABRASIVE-LIQUID POLISHING AND COMPENSATING NOZZLE

[75] Inventors: Mohamed Ahmed Hashish, Bellevue, Wash.; David Arthur Crowe, Webster; Neil Dean Armstrong, Greece, both of N.Y.

[73] Assignee: Eastman Kodak Company, Rochester, N.Y.

[21] Appl. No.: 581,880

[22] Filed: Jan. 2, 1996

Related U.S. Application Data

[63] Continuation of Ser. No. 126,296, Sep. 24, 1993, abandoned.

[51] Int. Cl.[6] ..... B24B 1/00; B24C 1/00

[52] U.S. Cl. ..... 451/40; 451/75; 451/41

[58] Field of Search ..... 451/75, 40, 90, 451/91, 99, 102, 38–41, 104, 36, 113, 28, 54–57, 65

[56] References Cited

U.S. PATENT DOCUMENTS

| | | | |
|---|---|---|---|
| 4,195,450 | 4/1980 | Korb et al. | 451/55 |
| 4,528,782 | 7/1985 | Bean | 51/439 |
| 4,704,826 | 11/1987 | Kurkland | 51/411 |
| 4,711,056 | 12/1987 | Herrington et al. | 451/75 |
| 4,716,690 | 1/1988 | Szues | 51/321 |
| 4,872,290 | 10/1989 | Jenkinson et al. | 451/259 |
| 5,011,443 | 4/1991 | Park | 134/7 |
| 5,018,670 | 5/1991 | Chalmers | 239/433 |
| 5,139,202 | 8/1992 | Munoz et al. | 239/587 |

FOREIGN PATENT DOCUMENTS

| | | | |
|---|---|---|---|
| 404135162 | 5/1992 | Japan | 451/41 |
| 230078 | 7/1925 | United Kingdom . | |

OTHER PUBLICATIONS

"An Accelerated Deep Polishing Method For Glass" Feb. '81; p. 124; M. A. Kalinina et al.

*Primary Examiner*—James G. Smith
*Assistant Examiner*—Derris H. Banks
*Attorney, Agent, or Firm*—Thomas H. Close

[57] ABSTRACT

A method and apparatus for polishing a glass surface by directing an abrasive fluid through a nozzle exit maintained in close proximity to the surface. The fluid is constrained between the nozzle exit and the surface so the fluid flows radially outwardly tangential to the surface as it changes from high pressure in the nozzle to high velocity in the tangential direction. Polishing is controlled by regulating the proximity of the nozzle exit to the surface. Apparatus is provided including a nozzle extension for delivering the abrasive liquid to the surface and a nozzle body supporting the extension for relative movement automatically to balance the axial forces on the nozzle extension.

11 Claims, 3 Drawing Sheets

ABRASIVE-LIQUID POLISHING AND COMPENSATING NOZZLE

This is a Continuation of application Ser. No. 08/126,296, filed 24 Sep. 1993, now abandoned.

BACKGROUND OF THE INVENTION

1.Field of the Invention

The invention relates to the use of an abrasive fluid under pressure for improving surface figure and finish and more specifically to grinding and polishing a glass surface with an abrasive fluid directed against the surface at high velocity and from controlled close proximity.

2. Description of the Prior Art

Traditional Approach

The precision grinding and polishing of hard materials, such as optical glass, typically includes several steps that progressively improve surface characteristics, particularly figure and finish. Starting from a blank that approximates the desired shape, material might be removed first by cutting, then by grinding and finally by lapping. Cutting typically is used to establish an approximate profile, while grinding refines the shape and lapping establishes the final figure and finished. Each stage removes less material but does so more precisely. Equally important, each stage removes stresses and damage to the surface from prior operations.

Precision grinding typically moves a rotary abrasive against the surface in minute increments. A massive support structure is used for rigidity, and a fine advancing mechanisms for precision. The abrasive locally fractures and removes material, but must be controlled to prevent damage from excessive heat or pressure.

Lapping employs a somewhat different approach including a relatively soft lap, usually a grooved plate, that slides over the work surface with a fine slurry there between. Figure and finish are established by the shape of the lap and the path and repetitions of movement over the surface.

Abrasive Fluids

High velocity jets including suspended abrasives have been used for removing one material from the surface of a different material (e.g. cleaning and sandblasting), and for precision cutting of glass and other hard materials (e.g. waterjet cutting). In cleaning and sandblasting applications, nozzles are provided primarily for aiming the particle stream rather imprecisely in the desired direction. In precision cutting operations, on the other hand, the nozzle is aimed more precisely and its location is controlled for movement relative to the work surface accurately to cut the desired contour. The objective in cutting normally is to make sure the stream passes entirely through the work, and there usually is no need to control precisely the spacing between the nozzle and the work. Similarly, there is no precision of confinement of the abrasive fluid between the work surface and the nozzle.

PROBLEM SOLVED BY THE INVENTION

Prior art devices of the traditional type must be limited in speed to prevent internal stresses and other damage, particularly when applied to large optics for observatories, and the like, that require perfection measured in the wavelengths of light. Grinding operations require precise control of mechanical movements, and lapping operations are slow by the very nature of the process. The speed of the abrasive relative to the work surface is limited by the mass of the abrasive tool or lap that supports the abrasive and applies it to the surface.

Previous devises also suffer from the relatively unyielding pressure between the abrasive and the work surface. High spots can result in substantial forces and heat, certainly against a hard abrasive, but also against the softer materials employed in a lap. Internal stresses from the resulting heat and strain have long term deleterious effects.

SUMMARY OF THE INVENTION

The present invention is directed to overcoming one or more of the problems set forth above, and to improving existing processes and apparatus for grinding and polishing hard surfaces such as optical glass. Briefly summarized, according to one aspect of the invention, a method and apparatus are provided for polishing a hard surface by directing a high-velocity stream of an abrasive fluid through a nozzle exit to impinge with force upon the surface, maintaining the nozzle exit in close proximity to the surface for constraining the stream between the nozzle and the surface, and controlling polishing by regulating the proximity of the nozzle to the surface. According to more specific features, the proximity of the nozzle to the surface is controlled automatically by balancing hydraulic pressures including the fluid pressure at the nozzle exit.

Apparatus is provided including a nozzle extension for directing the abrasive liquid against the surface to improve the finish of the surface, a nozzle body defining a passage for delivering the abrasive liquid under pressure to said nozzle extension, and a coupling permitting relative movement between said extension and said body for automatically balancing axial forces on said nozzle extension in response to said forces. In one embodiment, a seal is provided between the nozzle extension and the nozzle body for establishing frictional forces restraining said axial movement. In another embodiment, hydraulic back pressure is applied to said nozzle extension for balancing hydraulic forces and regulating the axial movement.

These and other aspects, objects, features and advantages of the present invention will be more clearly understood and appreciated from a review of the following detailed description of the preferred embodiments and appended claims, and be reference to the accompanying drawings.

ADVANTAGEOUS EFFECTS OF THE INVENTION

The invention permits increased speeds without the deleterious effects of prior art devices. Small abrasive particles are applied to the surface of the work in large quantities and at high velocities. The particles yield to excessive forces such as might be encountered, for example, at high spots, and the fluid is an effective medium for transferring any excessive heat away from the work surface.

Apparatus according to the invention is simple and self regulating. Spacing between the nozzle and the work surface is controlled relatively precisely and automatically even as the nozzle is worn away by the abrasive.

DESCRIPTION OF THE PREFERRED EMBODIMENTS

Figure 1:
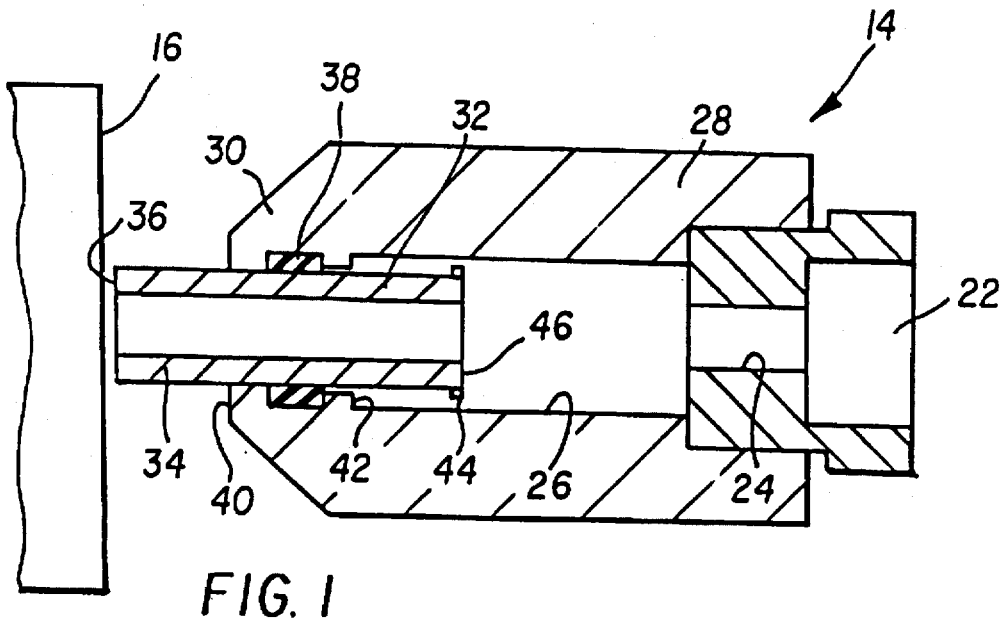
FIG. 1 is a cross-sectional view of a nozzle, in accordance with the invention, for directing an abrasive fluid against a surface to improve surface characteristics.
Figure 2:
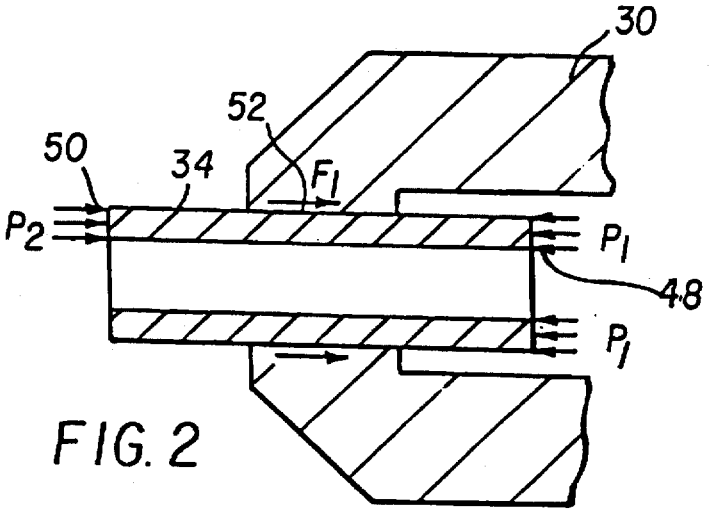
FIG. 2 is a partial cross-section of the nozzle of FIG. 1, depicting forces acting on portions of the nozzle and a seal between respective elements of the nozzle.
Figure 3:
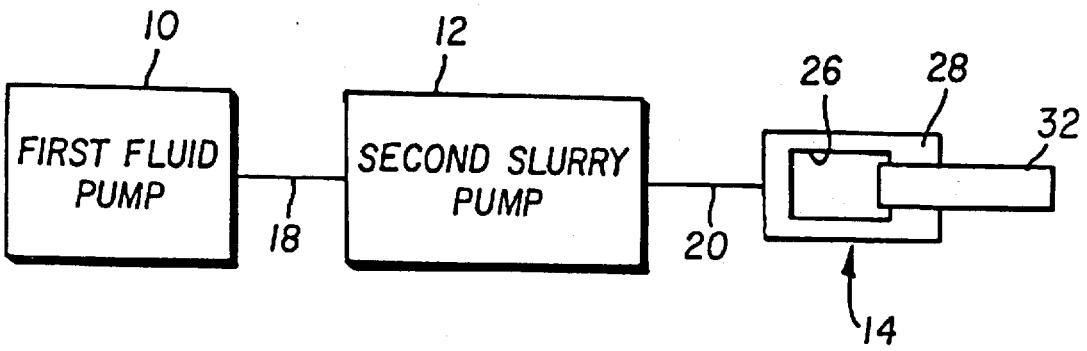
FIG. 3 is a block diagram representing a system including the nozzle of FIG. 1.

Referring now to the drawings, starting with FIGS. 1–3, a preferred embodiment of the invention is depicted including a first fluid pump 10, a second slurry pump 12, and a nozzle assembly 14 for directing an abrasive fluid, under pressure, and at high velocity, against a work surface 16.

The first pump 10 is used primarily to build pressure in a fluid, such as water, for delivery through high-pressure tubing 18 to second pump 12. The second pump contains a premixed slurry comprising the abrasive in a fluid, and is used to transfer the pressure from the first pump to the slurry. In this preferred embodiment, the second or slurry pump employs isolating pistons, the fluid is water and the pressure is up to approximately thirty thousand pounds per square inch (30,000 psi), but other pumps, pressures and fluids, both liquid and gas, could be used according to the features and to accomplish the advantages of the invention.

From the second pump 12 the slurry, containing the abrasive suspended in a fluid, is delivered to nozzle assembly 14 through high pressure tubing 20. The abrasive fluid enters the nozzle through a port 22 and passage 24 where it enters an internal nozzle chamber 26 defined by nozzle body 28.

The nozzle body includes a collar 30 reduced in cross section for receiving a nozzle extension 32 defining a tip 34 and exit 36. The extension is held in the nozzle body by a seal 38 captured between two annular abutments 40 and 42, but is moveable for sliding longitudinally of its axis relative to the nozzle body. A stop 44 keeps the extension in the body at one extreme of movement, while the body surfaces that define passage 24 operate for the same purpose at the other extreme of movement.

In operation, abrasive particles having a size of two or three microns (2–3μ), for purposes of this embodiment, are delivered in quantities exceeding one million per second at a velocity of four hundred feet per second (400 ft/sec.) when leaving the nozzle extension 32 under its exit face 36. The particle size appears to be an important factor in surface roughness, while the velocity and pressure appear more important to material removal rates.

The abrasive fluid is directed through the nozzle 14 to impinge lightly against the work surface 16 while accelerating tangentially relative to the surface as it escapes between the surface and the exit of nozzle tip 36. The nozzle is aimed for delivering the abrasives to workpiece surface and is positioned so the tip of the nozzle extension will be maintained in close proximity to the surface to constrain the stream between the nozzle and the surface. Control of the material removed is provided by regulating the proximity of the nozzle to the surface, the pressure and the exposure time of any particular location on the surface to the high-velocity abrasive stream.

According to a particularly advantageous feature of the invention, the proximity of the nozzle tip to the surface, or the spacing between the tip and the surface, is controlled automatically by a balancing of fluid pressures acting on the nozzle and its tip. In this preferred embodiment, the spacing is less than five thousandths of an inch (0.005 inches), and preferably less than one thousandths of an inch (0.001 inches). Nozzle extension 34 includes a first end 46 received in the nozzle body in communication with passage 24 and chamber 26, and a second or distal end at tip 36 for positioning adjacent the work surface as previously described. Between the first and second ends, seal 38 imposes friction and resistance to axial movement of extension relative to the body and thereby balances the hydraulic forces acting on the extension. This is depicted in FIG. 2.

The pressurized fluid exerts forces 48 on the extension 34 tending to move the extension toward the work surface. At the same time, the hydraulic forces 50 at the work surface tend to push the extension 34 back into the body 28. If the nozzle tip 36 moves too close to the surface, the forces at the surface increase and the extension is pushed back into the body until the proper distance is reestablished. Similarly, if the tip wears down from the abrasive action, the forces at the work surface decrease and the extension automatically advances to establish the proper spacing once again. Frictional forces 52 at seal 30 are selected to balance the forces at the desired spacing.

DESCRIPTION OF AN ALTERNATIVE EMBODIMENT

Figure 4:
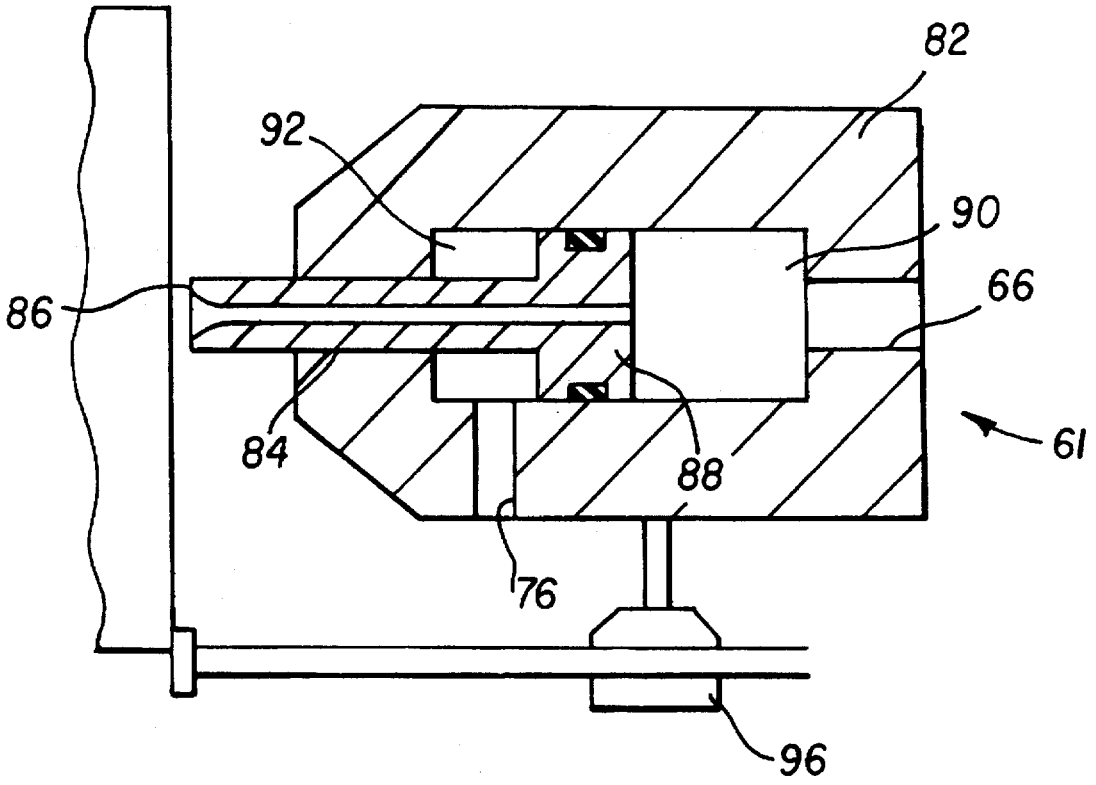
FIG. 4 is a cross-sectional view of a nozzle according to an alternative embodiment of the invention.
Figure 5:
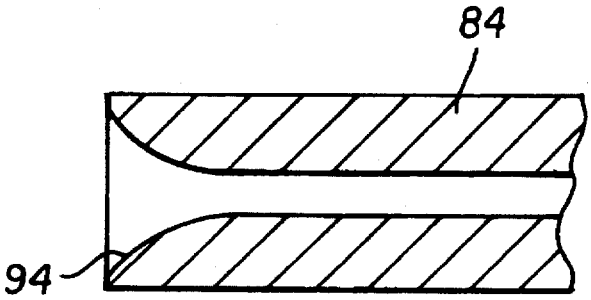
FIG. 5 is a partial cross-section of the nozzle of FIG. 4.
Figure 6:
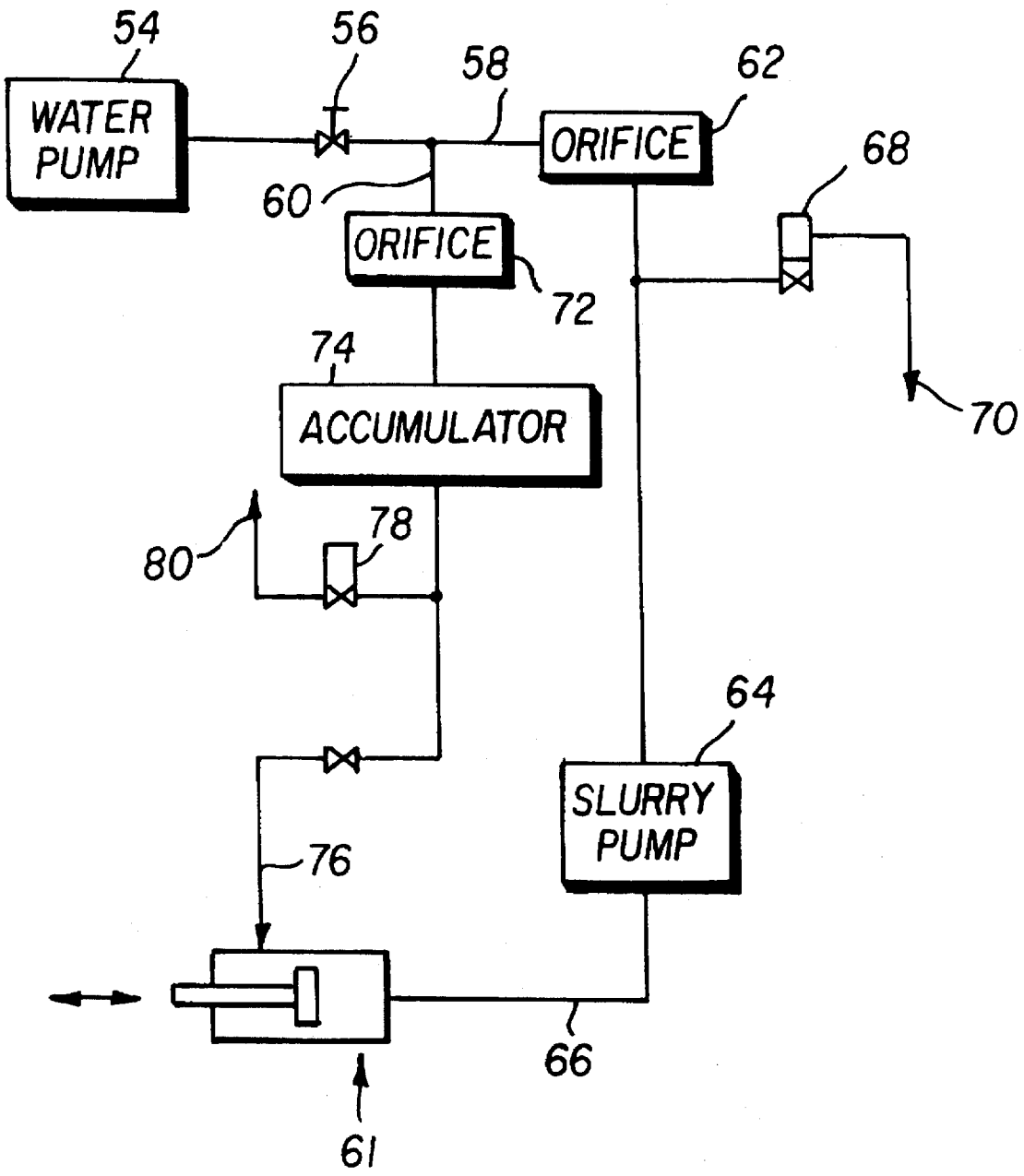
FIG. 6 is a block diagram representing an alternative system including the nozzle of FIG. 4.

FIGS. 4–6 depict an alternative embodiment of the invention. Starting with FIG. 6, water pump 54 generates pressure and delivers water through shut-off valve 56. The pressurized fluid is regulated and proportioned through two distribution lines 58 and 60 that both lead to a nozzle assembly 61. Line 58 includes an orifice 62 and slurry pump 64, similar to the preferred embodiment, for delivering the abrasive fluid through tubing 66 to the nozzle. A pressure relief valve 68 and vent 70 control the maximum pressure. Line 60 includes an orifice 72 and accumulator 74. The accumulator dampens pressure fluctuations in the system leading to the nozzle through tubing 76. A pressure relief valve 78 and vent 80 also are provided in this line.

Nozzle assembly 61 is similar in many respects to the preferred embodiment, including a nozzle body 82 and axially moveable nozzle extension 84 with an exit at its tip 86. The nozzle differs, however, in a compensating mechanism for balancing the hydraulic forces that automatically determine the space between the nozzle tip and the work surface. Nozzle extension 84 includes a piston 88 that divides the nozzle chamber into two sections 90 and 92. Pressure from line 60 enters section 92 through tubing 76 and provides back pressure for balancing the forces acting on the other side of the piston from section 92 of the chamber.

The nozzle tip has a different configuration including a funnel shape 94 wider toward the work surface for assisting transition of the fluid jet from its relatively slow moving normal direction to its high velocity tangential direction.

Although the position of the nozzle tip is controlled by the respective hydraulic and frictional forces, as described in connection with the preferred embodiment, a course location of the nozzle is provided by support 96, on which the nozzle is slideable to a rough set position relative to the work surface.

It should now be apparent that an improved method and apparatus are provided according to the invention having important advantages over prior art approaches, particularly as applied to the grinding and polishing of optical glass for telescopes and observatories.

While the invention has been described with particular reference to a preferred and alternative embodiment, it is not limited to the particular details of the examples illustrated, but covers other modifications and applications within the true spirit and scope of the invention.

PARTS LIST FOR FIGURES

Reference No. Part
10—first fluid pump.
12—second slurry pump.
14—nozzle assembly.
16—work surface.
18—high-pressure tubing.
20—high-pressure tubing.
22—port.
24—passage.
26—nozzle chamber.
28—nozzle body.
30—nozzle collar.
32—nozzle extension.
34—nozzle tip.
36—nozzle exit.
38—seal.
40—annular abutment.
42—annular abutment.
44—stop.
46—first end.
48—hydraulic force.
50—hydraulic force.
52—friction force.
54—water pump.
56—shut-off valve.
58—distribution line.
60—distribution line.
61—nozzle assembly.
62—orifice.
64—slurry pump.
66—tubing.
68—relief valve.
70—vent.
72—orifice.
74—accumulator.
76—tubing.
78—valve.
80—vent.
82—nozzle body.
84—nozzle extension.
86—nozzle tip.
88—piston.
90—chamber section.
92—chamber section.
94—funnel shape.
96—support.

What is claimed is:

1. A method of polishing a glass surface; comprising the steps of:

delivering a high-pressure abrasive fluid through a nozzle exit to the glass surface; and maintaining the nozzle exit in sufficiently close proximity to the glass surface to constrain and accelerate the fluid between the nozzle and the surface tangential to the surface such that only polishing and not cutting of the glass occurs.

2. The invention of claim 1, wherein said close proximity is within 0.005 inches.

3. The invention of claim 1, wherein polishing is controlled by regulating the proximity of the nozzle to the surface.

4. A method of polishing an existing glass surface; comprising the steps of:

applying a high pressure abrasive fluid through a nozzle exit to the glass surface; and constraining the fluid between the nozzle exit and the surface for directing the fluid at high velocity sufficiently substantially tangential to the glass surface such that only polishing and not curing of the glass occurs.

5. The invention of claim 4, wherein the tangential velocity of the stream at the surface is greater than one foot per second.

6. The invention of claim 4, wherein:

said maintaining of the nozzle exit in close proximity to the surface is accomplished by balancing hydraulic pressures including fluid pressure at the nozzle exit.

7. Apparatus using an abrasive liquid under pressure for improving surface finish; said apparatus comprising:

a nozzle extension for directing the abrasive liquid against a surface to improve the finish of the surface;

a nozzle body defining a passage for delivering the abrasive liquid under pressure to said nozzle extension;

means coupling said nozzle extension and said nozzle body for automatically balancing axial forces on said nozzle extension by permitting relative movement between said extension and said body in response to said forces;

the nozzle extension including a first end received in said nozzle body in communication with said passage, and a second end for positioning adjacent the surface, and wherein said coupling means permits axial movement of said nozzle extension relative to said nozzle body to balance said axial forces including forces at said first and second ends; and means for applying back pressure to said nozzle extension for regulating the force at the second end by balancing differences in said forces at said first and second ends.

8. Apparatus using an abrasive liquid under pressure for improving surface finish; said apparatus comprising;

a nozzle extension for directing the abrasive liquid against a surface to improve the finish of the surface;

a nozzle body defining a passage for delivering the abrasive liquid under pressure to said nozzle extension;

means coupling said nozzle extension and said nozzle body for automatically balancing axial forces on said nozzle extension by permitting relative movement between said extension and said body in response to said forces;

the nozzle extension including a first end received in said nozzle body in communication with said passage, and a second end for positioning adjacent the surface, and wherein said coupling means permits axial movement of said nozzle extension relative to said nozzle body to balance said axial forces including forces at said first and second ends; and a seal between said nozzle extension and said nozzle body, said seal establishing frictional forces restraining said axial movement.

9. Apparatus for polishing a glass surface with an abrasive liquid under pressure; said apparatus comprising:

a nozzle section for positioning in close proximity to the surface and directing the abrasive liquid along an axis substantially normal to the surface;

means mounting said nozzle section for balancing axial forces on said nozzle section to control automatically by said balancing the proximity of said nozzle section to the surface.

10. The invention of claim 9, wherein said nozzle section includes a first end distal from the surface, and a second end for positioning in close proximity to the surface, and wherein said mounting means permits axial movement of said nozzle section relative to said surface to balance forces at said first and second ends.

11. The invention of claim 10, including means for applying fluid back pressure to said nozzle section for regulating the proximity of said nozzle section to the surface.

* * * * *